US008172513B2

(12) United States Patent
Frankenstein et al.

(10) Patent No.: US 8,172,513 B2
(45) Date of Patent: May 8, 2012

(54) ADJUSTING SHAFT ARRANGEMENT OF A TURBOCHARGER

(75) Inventors: Dirk Frankenstein, Worms (DE); Volker Paul, Neustadt (DE); Ralf Boening, Reiffelbach (DE)

(73) Assignee: BorgWarner Inc., Auburn Hills, MI (US)

( * ) Notice: Subject to any disclaimer, the term of this patent is extended or adjusted under 35 U.S.C. 154(b) by 772 days.

(21) Appl. No.: 11/916,083

(22) PCT Filed: May 23, 2006

(86) PCT No.: PCT/EP2006/004906

§ 371 (c)(1),
(2), (4) Date: Jan. 28, 2009

(87) PCT Pub. No.: WO2006/128616

PCT Pub. Date: Dec. 7, 2006

(65) Prior Publication Data

US 2009/0226304 A1 Sep. 10, 2009

(30) Foreign Application Priority Data

Jun. 2, 2005 (DE) ..... 20 2005 008 606 U

(51) Int. Cl.
*F01D 25/16* (2006.01)
*F01D 17/10* (2006.01)

(52) U.S. Cl. ..... 415/133; 415/147

(58) Field of Classification Search ..... 415/130, 415/133, 147, 148, 149.1, 151, 156, 158, 415/160, 162

See application file for complete search history.

(56) References Cited

U.S. PATENT DOCUMENTS

| | | | | |
|---|---|---|---|---|
| 2,860,827 | A | 11/1958 | Egli | |
| 4,245,953 | A * | 1/1981 | Milton et al. | 415/144 |
| 5,046,317 | A * | 9/1991 | Satokawa | 60/602 |
| 5,593,275 | A * | 1/1997 | Venkatasubbu et al. | 415/160 |
| 6,179,297 | B1 * | 1/2001 | Bauman et al. | 277/437 |
| 7,008,194 | B2 * | 3/2006 | Frankenstein | 417/407 |
| 7,644,583 | B2 * | 1/2010 | Leavesley | 60/602 |
| 2011/0110767 | A1 * | 5/2011 | Castan et al. | 415/159 |

FOREIGN PATENT DOCUMENTS

| | | | |
|---|---|---|---|
| EP | 0972918 | A | 1/2000 |
| EP | 1130220 | A2 * | 9/2001 |
| EP | 1426563 | A | 6/2004 |
| GB | 2401652 | A | 11/2004 |
| WO | WO 02/059462 | A | 8/2002 |
| WO | WO 2004/063535 | A | 7/2004 |
| WO | WO 2004063535 | A1 * | 7/2004 |

* cited by examiner

*Primary Examiner* — Benjamin Sandvik
*Assistant Examiner* — Joseph Schoenholtz
(74) *Attorney, Agent, or Firm* — William G. Anderson; Stephan A. Pendorf; Patent Central LLC

(57) ABSTRACT

The invention relates to an adjusting shaft arrangement (1) of a variable turbine geometry turbocharger or waste gate turbocharger having an adjusting shaft (2) which has a fastening section (3); having a lever (4) which is connected to the adjusting shaft (2) via the fastening section (3); having a sleeve (5) which is arranged on a base body (6) of the adjusting shaft (2); and having a seal (7) which is arranged in the region of the base body (6) between the sleeve (5) and the adjusting shaft (2); the main body (6) of the adjusting shaft (2) having a stepped outer contour; and the sleeve (5) having an inner contour with a stepped inner contour which complements the design of the base body (6).

17 Claims, 2 Drawing Sheets

ADJUSTING SHAFT ARRANGEMENT OF A TURBOCHARGER

CROSS-REFERENCE TO RELATED APPLICATIONS

This application is a §371 national stage entry of International Application No. PCT/EP2006/004906, filed May 23, 2006, which claims priority to DE Application No. 202005008606.1, filed Jun. 2, 2005, the disclosures of which are both hereby incorporated by reference.

The invention relates to an adjusting shaft arrangement of a VTG turbocharger or wastegate turbocharger according to claim 1.

The term "VTG turbocharger" refers to a turbocharger having variable turbine geometry (VTG) which requires an adjusting shaft arrangement. In the wastegate turbocharger, the turbine bypass is controlled by means of a valve which is moved by the adjusting shaft.

In known adjusting shaft arrangements of VTG turbochargers, the problem of an imperfect sealing effect of the gap seal in the region between the adjusting shaft and the bush may occur depending on the exhaust-gas positive pressure applied, which may lead to exhaust-gas and smoke emissions of the turbocharger to the outside.

An improved seal by means of a piston ring arranged centrally in the bush is known from WO2004/063535 A1, such that its sealing effect is combined with the gap sealing effect.

However, this arrangement has the crucial disadvantage that the slip-on bevel, required for fitting the piston ring, in the bush bore markedly reduces the effective gap sealing length, since, in the case of a symmetrical bush geometry and fitting which is not laterally oriented, a slip-on bevel also expediently becomes necessary at the other bush end face.

It is therefore the object of the present invention to provide an adjusting shaft arrangement of a VTG or wastegate turbocharger which firstly constitutes a combination of gap seal and piston ring seal, in order to markedly reduce its exhaust-gas and smoke emissions to the outside, and secondly makes possible an improved sealing effect at the same bush length.

This object is achieved by the features of claim 1. The subclaims concern advantageous developments of the invention.

According to the invention, a static seal is provided between the adjusting shaft and the bush, said seal at least considerably reducing, if not entirely preventing, exhaust-gas and smoke emissions of the turbocharger to the outside via the bush.

The seal is preferably designed as a piston ring.

In an especially preferred embodiment, the seal is arranged in a groove of a main body of the adjusting shaft between a fixing section and a free end.

The main body is of stepped design, resulting in two cylindrical sections having different outside diameters. The inner contour of the bush surrounding the main body is likewise of complementary stepped design, thereby resulting in turn in two regions having a cylindrical inside diameter of different size. The transition between both regions can be designed as a slip-on bevel for fitting the piston ring, such that as long an effective sealing gap as possible remains at both ends. In this case, the annular space, produced by the transition, between bush and adjusting shaft can serve as a collecting volume for particles. Due to the particle accumulations in the collecting volume, an accumulation in the sealing gap, which may lead to sluggishness of the adjusting shaft, is avoided. The outside diameter of the bush need not necessarily be of stepped design. It may also be constant over the entire bush length. Stepping of the bush outside diameter has the additional advantage that laterally transposed incorrect fitting is prevented.

Further details, advantages and features of the invention follow from the description of two exemplary embodiments below with reference to the accompanying drawing, in which.

Figure 1:
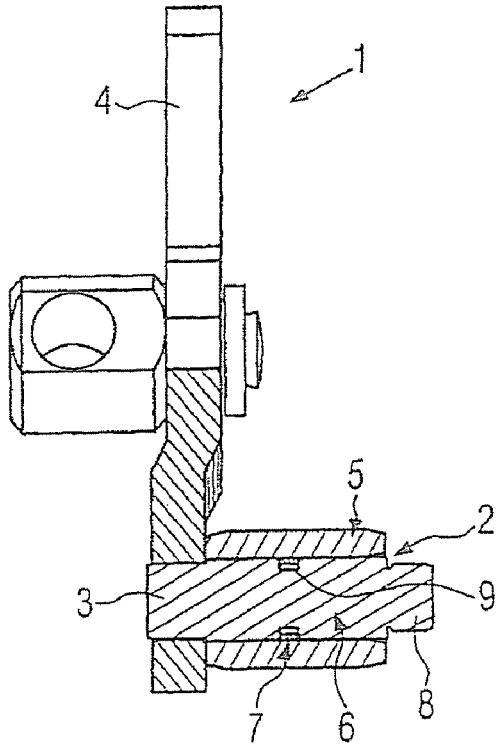
FIG. 1 (Prior art)
FIG. 1 shows a partly sectioned illustration of a known adjusting shaft arrangement.

A known adjusting shaft arrangement 1 of a VTG turbocharger is shown in FIG. 1. The VTG turbocharger itself is not shown in any more detail in the figures, since this can involve a conventional construction known per se.

The adjusting shaft arrangement 1 has an adjusting shaft 2 which comprises a fixing section 3 and a free end 8. Furthermore, FIG. 1 shows that the fixing section 3 and the free end 8 have a smaller outside diameter than a main body 6 of the adjusting shaft 2, said main body 6 being arranged between the fixing section 3 and the free end 8. All three sections have a cylindrical outer contour in the example.

The adjusting shaft 2 is connected to a lever 4 via the fixing section 3.

Furthermore, the adjusting shaft arrangement 1 has a bush 5, which is arranged on the basic body 6 of the adjusting shaft 2.

Finally, a seal 7 is provided which is arranged in the region of the basic body 6 between the bush 5 and the adjusting shaft 2. For this purpose, the basic body 6 has an encircling groove and the seal can preferably be designed as a piston ring which is arranged in the groove 9. A seal which markedly restricts the escape of smoke emissions or exhaust gases to the outside is therefore obtained between the bush 5 and the adjusting shaft 2 or its basic body 6.

In the adjusting shaft arrangement shown in FIG. 1, the basic body 6 of the adjusting shaft 2 is of continuously cylindrical or smooth design and slip-on bevels can clearly be seen at both bush end faces.

Figure 2:
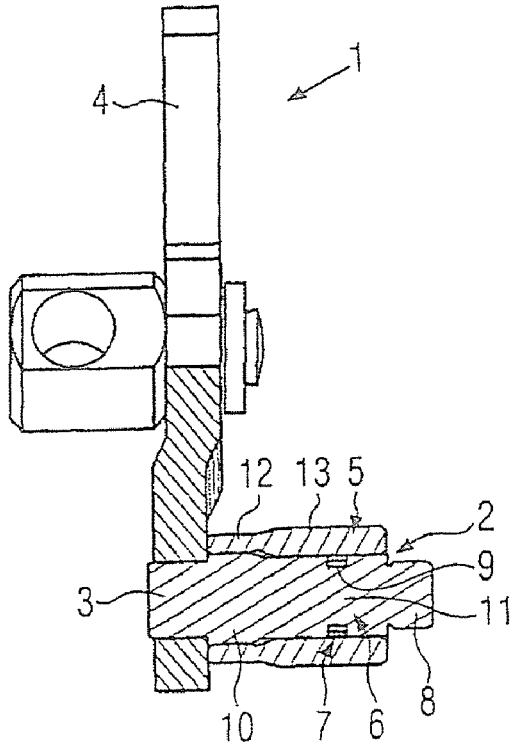
FIG. 2 shows an illustration, corresponding to FIG. 1, of a first embodiment of the adjusting shaft arrangement (VTG) according to the invention.

In contrast thereto, the first embodiment, shown in FIG. 2, of the adjusting shaft arrangement according to the invention is provided with a basic body 6 which is stepped, thereby resulting in two cylindrical sections 10 and 11 which have different outside diameters. In the embodiment shown, the section 10 has a larger outside diameter than the section 11.

Accordingly, the bush 5 has a larger inside diameter in the region of the section 10 than in the region which surrounds the section 11 of the adjusting shaft 2.

The seal 7 is also arranged in a groove of the basic body 6 in the embodiment according to the invention. Therefore reference may be made to the description of FIG. 1 with regard to all the corresponding features.

As FIG. 2 also shows, the bush 5 likewise has two sections 12 and 13, the section 12 with the larger inside diameter surrounding the section 10 of the adjusting shaft 2, whereas the section 13 surrounds the region 11 of the adjusting shaft 2 of smaller outside diameter. Furthermore, the section 12 of the bush 13 has a smaller outside diameter than the section 13 of the bush 5. In this respect, reference may be made to the diagrammatic illustration in FIG. 2 for additional disclosure.

Figure 3:
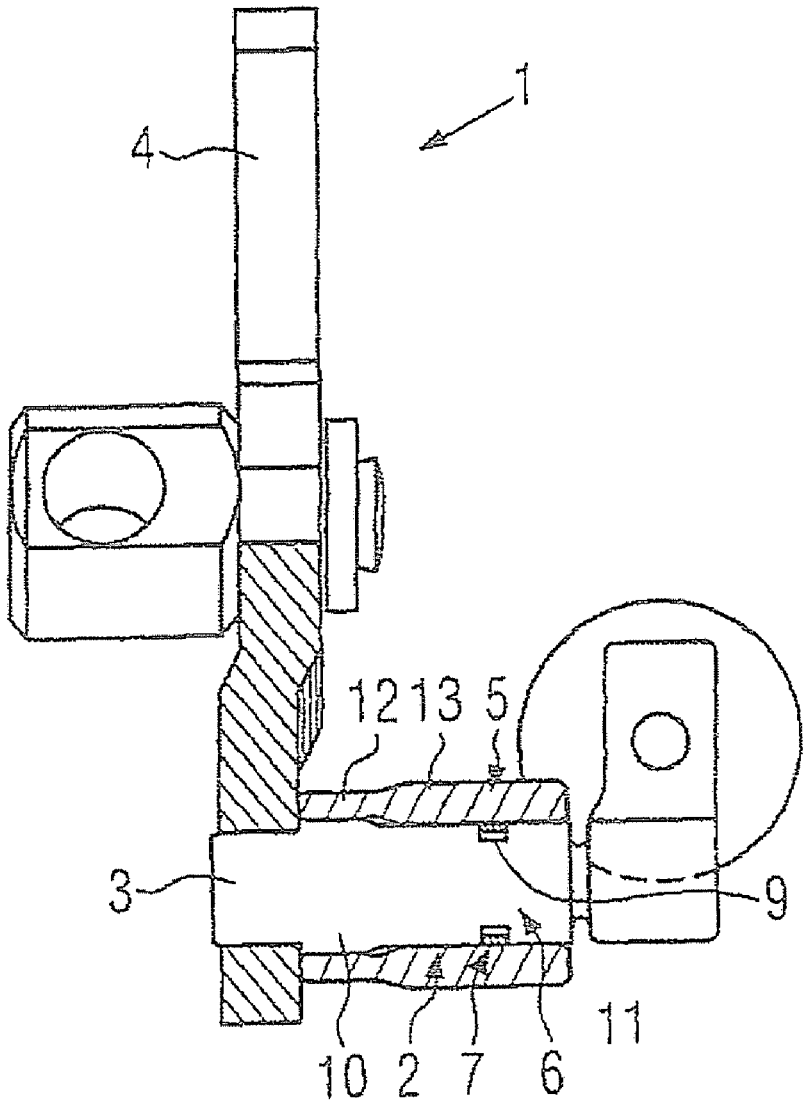
FIG. 3 shows an illustration, corresponding to FIG. 1, of a second embodiment of the adjusting shaft arrangement (wastegate) according to the invention.

A second embodiment which is provided for a wastegate turbocharger is shown in FIG. 3. Since the design of an adjusting shaft also corresponds to that of FIG. 2, reference may be made to the above explanations.

LIST OF DESIGNATIONS

1 Adjusting shaft arrangement
2 Adjusting shaft
3 Fixing section
4 Lever
5 Bush
6 Basic body
7 Seal
8 Free end
9 Groove
10 Section of the adjusting shaft 2 of large outside diameter
11 Section of the adjusting shaft 2 of smaller outside diameter
12 Section of the bush 5 of larger inside diameter
13 Section of the bush 5 of smaller inside diameter
14 Slip-on bevel
15 Collecting volume

The invention claimed is:

1. An adjusting shaft assembly (1) of a VTG or wastegate turbocharger, the assembly comprising:

an adjusting shaft (2) which has a fixing section (3);

a lever (4) which is connected to the adjusting shaft (2) via the fixing section (3);

a bushing (5) which is positioned on a body (6) of the adjusting shaft (2); and a seal (7) which is positioned in a region of the body (6) between the bushing (5) and the adjusting shaft (2), wherein the body (6) of the adjusting shaft (2) has a stepped outer contour, and wherein the bushing (5) has an inner contour which is complementary to the stepped outer contour of the body (6).

2. The assembly as claimed in claim 1, wherein the seal (7) is a piston ring.

3. The assembly as claimed in claim 1, wherein the seal (7) is positioned in a groove (9) of the adjusting shaft (2).

4. The assembly as claimed in claim 1, wherein the adjusting shaft (2) has a free end (8) with an outer diameter that is smaller than an outer diameter of the body (6) of the adjusting shaft (2).

5. The assembly as claimed in claim 1, wherein the adjusting shaft (2) has a free end (8) with an outer diameter that is smaller than an outer diameter of the body (6) of the adjusting shaft (2).

6. The assembly as claimed in claim 1, wherein the bushing (5) has a stepped outer contour.

7. An adjusting shaft assembly (1) of a VTG or wastegate turbocharger, the assembly comprising:

an adjusting shaft (2) which has a fixing section (3);

a lever (4) which is connected to the adjusting shaft (2) via the fixing section (3);

a bushing (5) which is positioned on a body (6) of the adjusting shaft (2); and a seal (7) which is positioned along a groove in a region of the body (6) between the bushing (5) and the adjusting shaft (2), wherein the body (6) of the adjusting shaft (2) has at least two different outer diameters, and wherein the bushing (5) has at least two different inner diameters that correspond with the at least two different outer diameters of the body (6) to provide sealing between the bushing (5) and the adjusting shaft (2).

8. The assembly as claimed in claim 7, wherein the seal (7) is a piston ring.

9. The assembly as claimed in claim 7, wherein the adjusting shaft (2) has a free end (8) with an outer diameter that is smaller than a largest outer diameter of the body (6) of the adjusting shaft (2).

10. The assembly as claimed in claim 7, wherein the bushing (5) has a stepped outer contour.

11. The assembly as claimed in claim 7, wherein the adjusting shaft (2) has a free end (8) connected to a waste gate valve.

12. A method of sealing an adjusting shaft assembly (1) of a VTG or wastegate turbocharger, the method comprising:

providing an adjusting shaft (2) which has a fixing section (3);

connecting a lever (4) to the adjusting shaft (2) via the fixing section (3);

positioning an O-ring seal (7) in a groove formed in the body (6); and positioning a bushing (5) around a body (6) of the adjusting shaft (2) thereby covering the O-ring sealing (7), wherein the body (6) of the adjusting shaft (2) has a stepped outer contour, and wherein the bushing (5) has an inner contour which is complementary to the stepped outer contour of the body (6).

13. The method as claimed in claim 12, wherein the adjusting shaft (2) has a free end (8) with an outer diameter that is smaller than an outer diameter of the body (6) of the adjusting shaft (2).

14. The method as claimed in claim 12, further comprising connecting a free end (8) of the adjusting shaft (2) to a waste gate valve.

15. The method as claimed in claim 12, wherein the bushing (5) has a stepped outer contour.

16. The assembly as claimed in claim 1, wherein substantially the entire body (6) of the adjusting shaft (2) is surrounded by the bushing (5), and wherein the fixing section (3) is not surrounded by the bushing (5).

17. The assembly as claimed in claim 1, wherein the body (6) of the adjusting shaft (2) includes a first substantially cylindrical section (10) and a second substantially cylindrical section (11), wherein the first substantially cylindrical section (10) has an outer diameter that is larger than an outer diameter of the second substantially cylindrical section (11), and wherein the first substantially cylindrical section (10) is located substantially adjacent to the lever (4).

* * * * *